US011105224B2

(12) United States Patent
Laumen et al.

(10) Patent No.: US 11,105,224 B2
(45) Date of Patent: Aug. 31, 2021

(54) WATER-INJECTION SYSTEM FOR POWER PLANTS

(71) Applicant: FEV Europe GmbH, Aachen (DE)

(72) Inventors: Hermann Laumen, Heinsberg (DE); Mohamed Douch, Vaals (NL)

(73) Assignee: FEV Europe GmbH, Aachen (DE)

( * ) Notice: Subject to any disclaimer, the term of this patent is extended or adjusted under 35 U.S.C. 154(b) by 7 days.

(21) Appl. No.: 16/721,336

(22) Filed: Dec. 19, 2019

(65) Prior Publication Data

US 2020/0232346 A1 Jul. 23, 2020

(30) Foreign Application Priority Data

Dec. 19, 2018 (DE) ..... 102018132811.7

(51) Int. Cl.
*F01K 7/16* (2006.01)
*F01K 13/02* (2006.01)
*F22D 5/26* (2006.01)

(52) U.S. Cl.
CPC ..... *F01K 7/165* (2013.01); *F01K 13/02* (2013.01); *F22D 5/26* (2013.01)

(58) Field of Classification Search
CPC . F01K 7/165; F01K 13/02; F22D 5/26; F22G 5/12
USPC ..... 60/646, 657–658
See application file for complete search history.

(56) References Cited

U.S. PATENT DOCUMENTS 3,708,976 A * 1/1973 Berlyn ..... F02G 3/02 60/39.25
3,818,699 A * 6/1974 Pritchard ..... F22G 5/12 60/665
3,908,382 A * 9/1975 Stone, Jr. ..... F01K 27/00 60/649
6,804,963 B1 * 10/2004 Tomoiu ..... F02B 75/26 60/670
2004/0124259 A1 * 7/2004 Guezennec ..... F01N 3/2013 239/135
2006/0225672 A1 * 10/2006 Donahue ..... F02M 25/0225 123/25 P

* cited by examiner

*Primary Examiner* — Hoang M Nguyen
(74) *Attorney, Agent, or Firm* — Burris Law, PLLC

(57) ABSTRACT

A water-injection system for power plants and for injecting water into a steam system includes a supply unit, a metering unit and an injection unit. The supply unit is configured to make water available to the metering unit. The metering unit is in the form of an electrically actuable system and is configured to meter a quantity of water to be injected into the steam system and to make it provide to the injection unit. The injection unit is configured to introduce the water into the steam system.

18 Claims, 4 Drawing Sheets

WATER-INJECTION SYSTEM FOR POWER PLANTS

CROSS-REFERENCE TO RELATED APPLICATIONS

This application claims priority to and the benefit of German Patent Application No. 102018132811.7 filed on Dec. 19, 2018. The disclosure of the above application is incorporated herein by reference.

FIELD

The present disclosure relates to water-injection systems for power plants for injecting water into a steam system.

BACKGROUND

The statements in this section merely provide background information related to the present disclosure and may not constitute prior art.

In gas and/or steam power plants, water is injected into a steam system when, as the turbine is being started up, the steam is not yet hot enough or when, as the turbine is being powered down, the steam has to be cooled. The quantity of water is metered via an upstream valve. This metering valve is usually configured in the form of a spindle valve and is opened and/or closed via a stepping motor.

WO2018/117957A1 discloses an attemperator comprising a pipe, a pipe casing and an injection system for introducing water into the pipe for the purpose of cooling steam.

The present disclosure addresses the issues related to injection systems for introducing water into a steam system for the purpose of cooling steam and other issues related to water-injection systems.

SUMMARY

This section provides a general summary of the disclosure and is not a comprehensive disclosure of its full scope or all of its features.

In one form of the present disclosure a water-injection system for power plants and for injecting water into a steam system comprises a supply unit, a metering unit and an injection unit. The supply unit is configured to provide water to the metering unit. The metering unit is in the form of an electrically actuable system and is configured to meter a quantity of water to be injected into the steam system and to provide a quantity of water to the injection unit. The injection unit is configured to introduce the quantity of water into the steam system.

In some variations of the present disclosure, the injection pressure is greater than a steam pressure in the steam system. In at least one variation the injection pressure is at least 50 bar greater than the steam pressure in the steam system. For example, in some variations the steam pressure in the steam system is at least 50 bar, and in at least variation the steam pressure is at least 100 bar, and the water injection pressure is at least 50 bar greater than the steam pressure of 50 bar or 100 bar.

The metering unit of the water-injection system comprises at least one metering valve and a servo valve. The metering valve meters the quantity of water to be injected into the steam system and is actuated by the servo valve such that flexible control of water injection quantities is provided. The metering valve can be controlled servo-hydraulically and the servo valve can be configured with electromagnetic and/or piezoelectric actuators.

In some variations the injection unit comprises a water-injection valve and an injection line. The injection unit is connected to the metering unit via the injection line such that the quantity of water metered by the metering unit is introduced into the steam system through the water-injection valve.

In at least one variation, the injection line of the water-injection system is configured such that the water-injection valve is spaced apart from the metering valve and the servo valve, and overheating of the metering valve and/or of the servo valve is reduced or prevent. This arrangement of the water-injection valve, metering valve and servo valve reduces or prevents the likelihood of failure of the metering valve and/or of the servo valve on account of excessively high temperatures. In some variations the distance between the water-injection valve and metering valve and the servo valve is at least 10 cm, for example at least 30 cm or at least at least 50 cm.

In some variations of the present disclosure, the water-injection system comprises a control device configured to:

provide the water via the supply unit, initiate the water-injection operation by actuation of the metering unit, and terminate the water-injection operation by deactivation of the metering unit.

Accordingly, it should be understood that the control device provides a dynamic and precise metering of the quantity of water to be injected into the steam.

In another form of the present disclosure, a water-injection system for cooling steam in a power plant comprises a supply unit, a metering unit, an injection unit, and an injection line extending between the metering unit and the injection unit. The supply unit comprises a pump and a storage volume, and the pump is configured to pump water into the storage volume at a predefined pressure. The metering unit comprises a metering valve and a servo valve, and the servo valve is configured to be electromagnetically actuated into an open position such that water flows from the storage volume through the metering valve and into the injection line. The injection unit comprises a water-injection valve configured to open when the metering valve is open such that water flows from the injection line and through the injection valve into a steam system with steam. In some variations, metering unit includes electromagnetic actuators that electromagnetically actuate the servo valve from a closed position to the open position. In such variations, the metering valve can be configured to move from a closed position to an open position when the servo valve moves from the closed position to the open position.

In at least one variation the metering valve is spaced apart from the water-injection valve by more than 10 centimeters and/or the water-injection valve is positioned at an elevated height relative to the metering valve. For example, in one variation the metering valve is spaced apart from the water-injection valve by more than 30 centimeters and the water-injection valve is positioned at an elevated height relative to the metering valve.

In still another form of the present disclosure, a water-injection system for injecting water into a steam system of a power plant and cooling steam in the steam system includes a supply unit comprising a storage container, a filter, a storage volume and a pump. The water-injection system also includes a metering unit in fluid communication with the supply unit and comprising a metering valve, a servo valve, a restrictor and a valve slide, and an injection unit comprising a spring and a water injection valve. The pump is configured to pump water from the storage container to the metering unit and the servo valve is configured to be electromagnetically actuated into an open position. Also, the metering valve is configured to move from a closed position to an open position when the servo valve is actuated into the open position and via the water pumped from the storage container to the metering unit such that water flows from the metering unit to the injection unit. In at least one variation of the present disclosure, the water injection valve is configured to move from a closed position to an open position via the water flowing from the metering unit to the injection unit such that water is injected into the steam system of the power plant and steam in the steam system is cooled.

In some variations, the water-injection valve is positioned at an elevated height relative to the metering valve and/or the metering valve is spaced apart from the water-injection valve by more than 50 centimeters.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
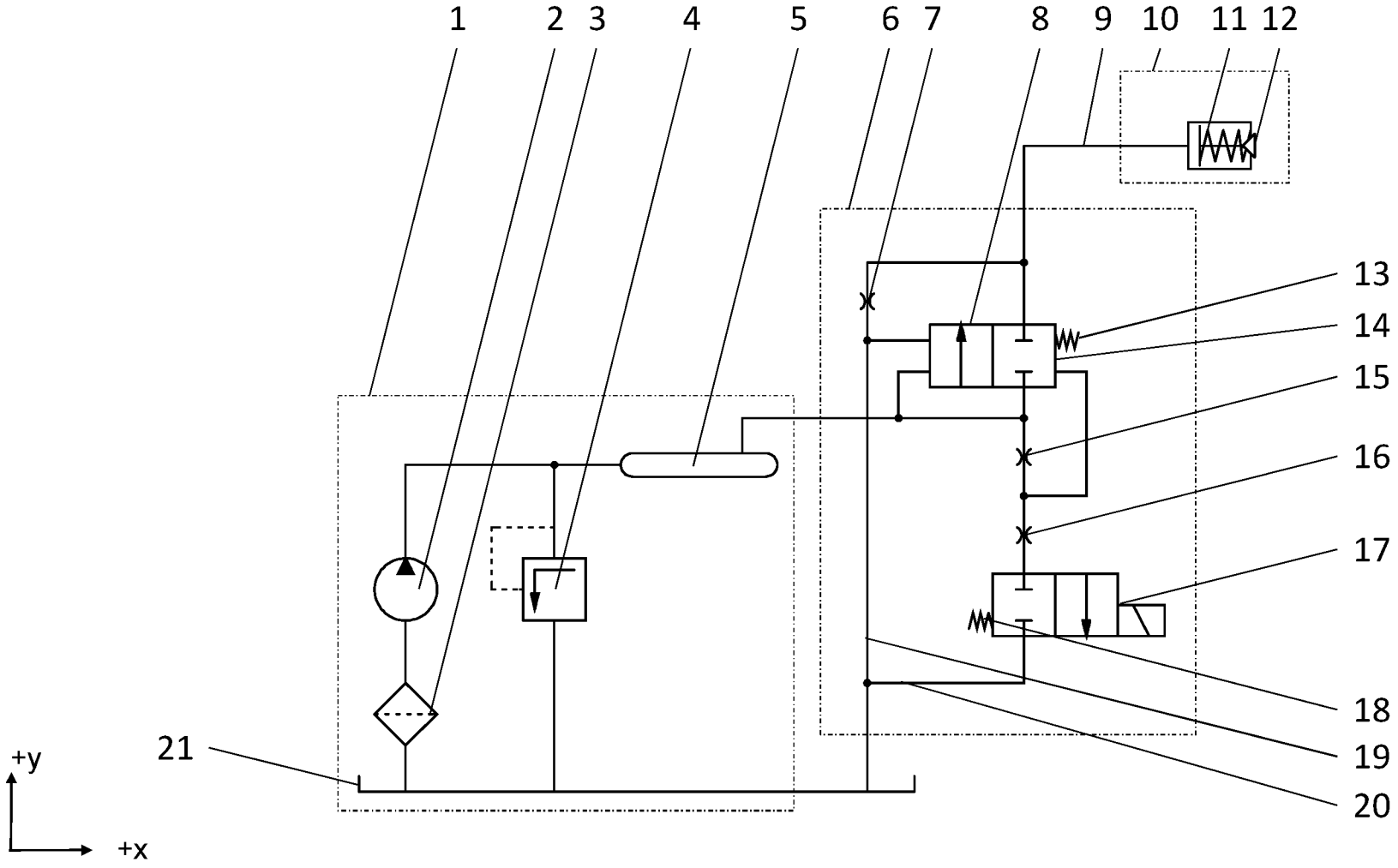
FIG. 1 shows a water-injection system according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
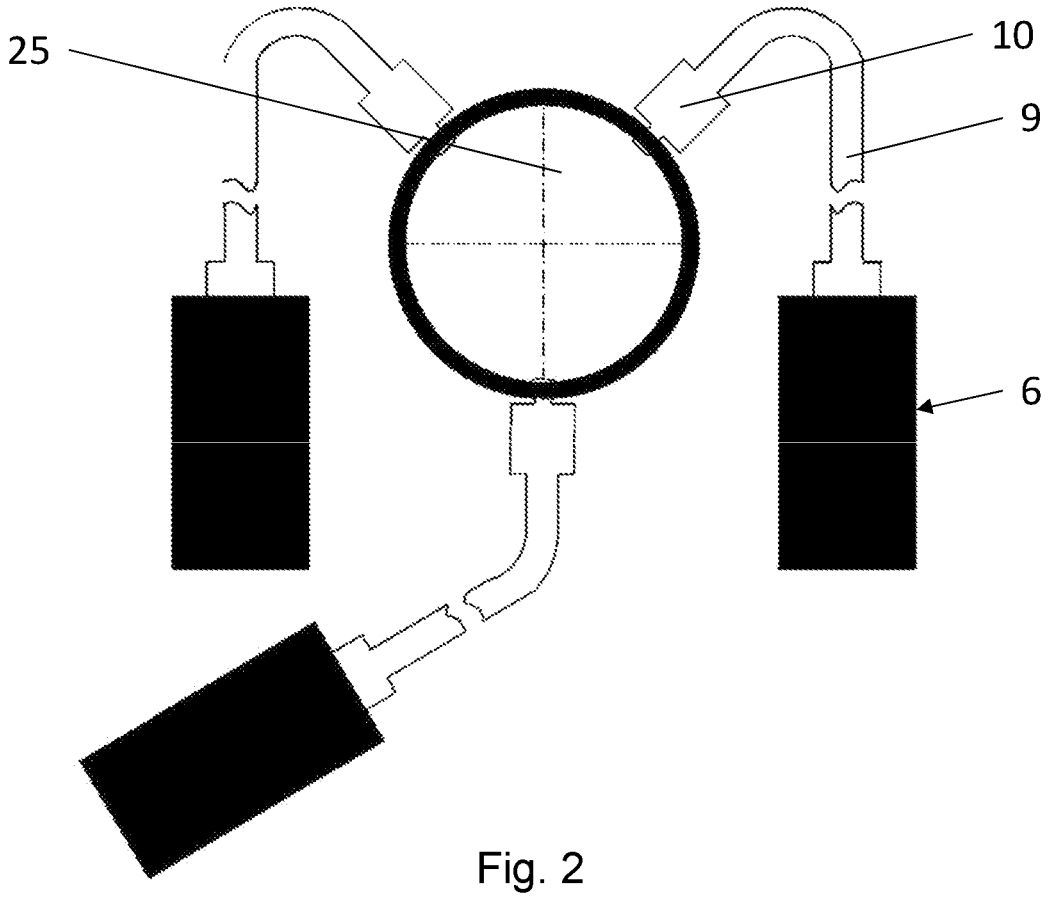
FIG. 2 shows an injection unit of a water-injection system according to the teachings of the present disclosure.
Figure 3:
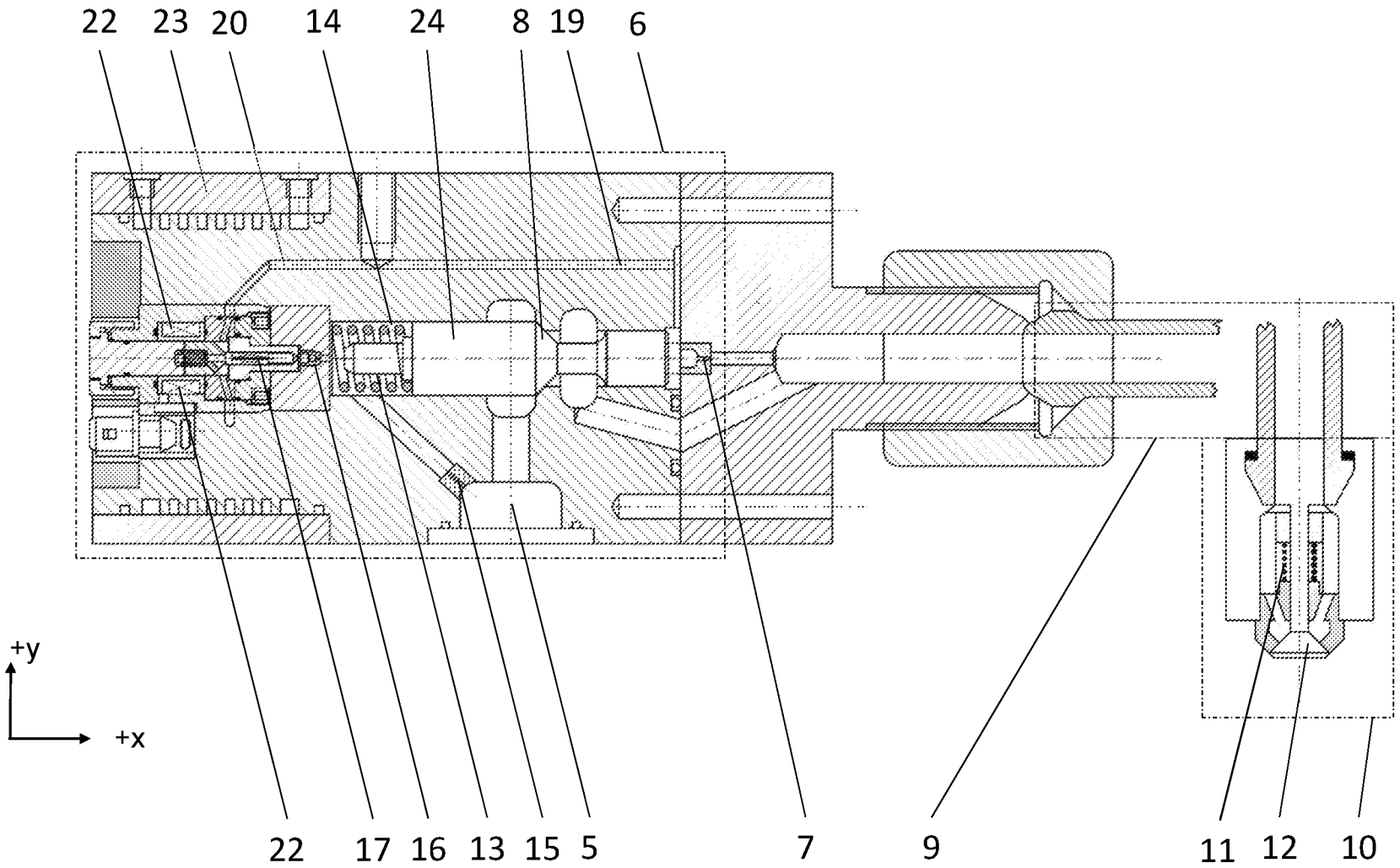
FIG. 3 shows a cross-sectional view of a metering unit and of an injection unit of a water-injection system according to the teachings of the present disclosure.

Referring to FIGS. 1-3, FIG. 1 shows a water-injection system for power plants and for injecting water into a steam system according to one form of the present disclosure. The water-injection system comprises a supply unit 1, a metering unit 6 and an injection unit 10. The supply unit 1 is designed to make water available to the metering unit 6. In some variations of the present disclosure, the metering unit 6 is an electrically actuable system and is designed to meter the quantity of water to be injected into the steam system and to make it available to the injection unit 10. The injection unit 10 is configured to introduce the metered quantity of water into a steam system 25 shown in FIG. 2.

The metering unit 6 comprises at least one metering valve 8 and a servo valve 17. Via a restrictor 15, a hydraulic fluid, for example water, passes into a control space 14 on an end side or an end (−x direction) of a valve slide 24 shown in FIG. 3 and retains the valve slide 24 in a closed position such that the metering valve 8 is closed. This state (i.e., the closed state, +x direction) is maintained as long as the servo valve 17, which can be actuated electromagnetically, is not actuated. When the servo valve 17 is actuated, it opens (−x direction), water escapes from the control spaced 14 via a restrictor 16, and the pressure in the control space 14 decreases. As a result, the valve slide 24 moves out of the closed position (i.e., into an open position, −x direction), counter to the spring 13, and the metering valve 8 opens. The water passes into an injection line 9 through the metering valve 8. If the electric current (i.e., power) is switched off, then, in the first instance, the servo valve 17 is closed via a closing spring 18. Thereafter, a relatively high pressure builds up again in the control space 14, and therefore the metering valve 8 likewise closes. The pressure in the injection line 9 decreases as a result.

As shown in FIG. 1, the injection unit 10 comprises a water-injection valve 12. The injection unit 10 is connected to the metering unit 6 via the injection line 9. The water-injection valve 12 is configured such that it opens in the outward direction (+x direction). In the rest state, it is retained by the steam pressure in the steam system 25 and, in addition by a spring 11, in the closed position. When the metering valve 8 opens, the pressure in the injection line 9 and in the injection unit 10 increases. The water-injection valve 12 opens and the injection operation begins. When the metering valve 8 closes, the pressure in the injection line 9 decreases and the water-injection valve 12 also closes (−x direction).

The injection line 9 is configured such that the injection unit 10 is spaced apart by a sufficient extent from the metering valve 8 and the servo valve 17. This advantageously achieves the situation where there is no overheating of the metering valve 8 and/or of the servo valve 17. Particularly, in some variations electromagnetic actuators 22 (FIG. 3), e.g., o piezoelectric actuators, can be used for controlling the injection operation and are not positioned in the immediate vicinity of the injection valve 12. It should be understood that electromagnetic actuators 22, e.g., piezoelectric actuators can fail at temperatures above 200° C., thereby making it desirable for the metering valve 8 and the pressure-controlled water-injection valve 12 to be spaced apart from each other.

In some variations of the present disclosure, the water-injection valve 12 is arranged above (+y direction) the metering valve 8 and the servo valve 17, and therefore the water-injection valve 12 is at a higher geodetic height than the metering valve 8 and the servo valve 17. It should be understood that such an arrangement reduces or avoids the occurrence of a so-called heat pipe since steam bubbles which occur on the water-injection valve 12, on account of buoyancy, do not reach the metering valve 8 and/or the servo valve 17.

Referring particularly to FIG. 2, in some variations the injection line 9 is configured in a curved state and directly on the water-metering unit 10 and the injection valve 12 (FIG. 1). It should be understood that such a configuration reduces or avoids the situation where the injection line acts as a heat pipe and the metering valve 8 and/or the servo valve 17 are/is possibly damaged as a result.

In at least one variation the injection unit 10 comprises a restrictor 7 as shown in FIG. 1, via which the injection line 9 can be relieved of loading. The relief of loading reduces or avoids the situation where uncontrolled injection operations take place on account of the formation of steam bubbles in the injection line 9 as a result of undesired buildup of pressure following the closure of the metering valve 8.

In some variations, the supply unit 1 comprises a storage container 21, a filter 3, a suitable storage volume 5 and a pump 2. The supply unit 1 is configured to store water in the storage volume 5 at a pressure advantageous for the water-injection system and to make this water available to the metering unit 6. The pump 2 takes in water from the storage container 21, via the filter 3, and delivers it into the storage volume 5. The pressure in the storage volume 5 is higher than the pressure in the steam system 25 and the pressure difference is adjusted via a pressure regulator 4. The pressure can be regulated by suitable control of the pump 2. Relatively small droplets resulting from the higher pressure in the storage volume 5 allow a relatively large surface area and relatively quick evaporation of the water entering the steam system 25 and therefore relatively quick mixing and cooling of the steam. For an advantageous reduction in the droplet diameters, the difference in pressure between the pressure in the storage volume 5 and the pressure in the steam system 25 is at least 10 bar, preferably ranging from 20-80 bar, particularly preferably ranging from 40-60 bar.

Referring particularly to FIG. 3, a cross-sectional and more detail view of the metering unit 6 and the injection unit 10 according to one form of the present disclosure is shown. Compressed water is provided via the storage volume 5 to the metering unit 6 via the restrictor 15, and the water passes into the control space 14 on the end side of the valve slide 24 and retains the valve slide 24 in the closed position. By the restrictor 16, the water passes to the servo valve 17, which in the rest state is closed, and therefore the pressure in the control space 14 is maintained and the metering valve 8 remains closed. If the servo valve 17 is opened, by the electromagnetic actuators 22 being actuated, the water can escape from the control space 14, via a return line 20, to the storage container 21. The pressure in the control space 14 decreases as a result, and therefore the valve slide 24 is moved, counter to the spring 13, into an at least partially open position (−x direction) and the water can flow to the water-injection valve 12 via the injection line 9. If the electric current of the electromagnetic actuators 22 is switched off, then, in the first instance, the servo valve 17 is closed via the closing spring 18. Thereafter, a relatively high pressure builds up again in the control space 14, and therefore the metering valve 8 can be closed by the spring 13. The pressure in the injection line 9 therefore decreases, as a result of which the water-injection valve 12 also closes. In order to avoid the situation where uncontrolled injection operations take place as a result of the formation of steam bubbles in the injection line 9 on account of undesired buildup of pressure once current has been switched off, the injection line 9 is relieved of loading via the restrictor 7. Via the restrictor 7, the water passes back to the storage container 21 through the line 19. In some variations, the water-injection system comprises a cooling system 23 as shown in FIG. 3 for the purpose of cooling the servo valve 17.

Figure 4:
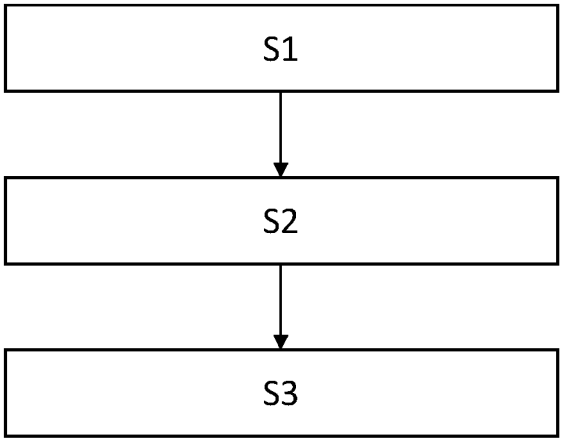
FIG. 4 shows a flow chart for a method carried out by a control device of a water-injection system according to the teachings of the present disclosure.

Referring now to FIG. 4, the water-injection system comprises a control device which is intended to carry out the following steps: providing the water at S1 via the supply unit 1, initiating the water-injection operation at S2 by actuation of the metering unit 6, and terminating the water-injection operation at S3 by deactivation of the metering unit 6. This has the advantageous effect of it being possible for the water-injection operation to take place in automated and iterative fashion.

The control device here initiates the water-injection operation at S2, and terminates the water-injection operation at S3, on the basis of the state of the steam in the steam system 25. This provides for adaptive operation of the water-injection system, and therefore, in adaptation to the present state of the steam, injection is carried out with an appropriately metered quantity of water.

Possible advantages of the teachings of the present disclosure, on account of the electrical actuation of the metering unit, are advantageous dynamics and precise metering of the quantity of water which is to be injected into the steam. The electrical actuation takes place preferably electromagnetically or piezoelectrically.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

In this application, the term "controller" or "control device" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The invention claimed is:

1. A water-injection system for power plants and for injecting water into a steam system, the water-injection system comprising:

a supply unit, a metering unit comprising at least one metering valve and a servo valve, and an injection unit comprising a water-injection valve connected to the metering unit via an injection line, wherein the supply unit is configured to provide water to the metering unit, the metering unit is in the form of an electrically actuable system and is configured to meter a quantity of water to be injected and to provide the quantity of water to the injection unit, and the injection unit is configured to introduce the water into the steam system.

2. The water-injection system according to claim 1, wherein the injection line is configured such that the water-injection valve is spaced apart from the metering valve and the servo valve by a distance such that overheating of the metering valve and/or of the servo valve is reduced.

3. The water-injection system according to claim 1, wherein the water-injection valve is positioned above the metering valve and the servo valve.

4. The water-injection system according to claim 1, wherein the injection line is configured in a curved state directly on the water-injection valve.

5. The water-injection system according to claim 1, wherein the injection unit comprises a restrictor, via which the injection line is relieved of loading.

6. The water-injection system according to claim 1, wherein the supply unit comprises a storage container, a filter, a storage volume and a pump and wherein the supply unit is configured to store the water in the storage volume under such.

7. The water-injection system according to claim 1 further comprising a control device, wherein the control device is configured to:

provide the water via the supply unit, initiate a water-injection operation by actuation of the metering unit, and terminate the water-injection operation by deactivation of the metering unit.

8. The water-injection system according to claim 7, wherein the control device initiates the water-injection operation, and terminates the water-injection operation, on the basis of the state of the steam in the steam system.

9. A water-injection system for cooling steam in a power plant, the water-injection system comprising:

a supply unit, a metering unit, an injection unit, and an injection line extending between the metering unit and the injection unit;

wherein:

the supply unit comprises a pump and a storage volume, and the pump is configured to pump water into the storage volume at a predefined pressure;

the metering unit comprises a metering valve and a servo valve, and the servo valve is configured to be electromagnetically actuated into an open position such that water flows from the storage volume through the metering valve and into the injection line; and the injection unit comprises a water-injection valve configured to open when the metering valve is open such that water flows from the injection line and through the injection valve into a steam system with steam.

10. The water-injection system according to claim 9 further comprising electromagnetic actuators that electromagnetically actuate the servo valve from a closed position to the open position.

11. The water-injection system according to claim 10, wherein the metering valve is configured to move from a closed position to an open position when the servo valve moves from the closed position to the open position.

12. The water-injection system according to claim 9, wherein the metering valve is spaced apart from the water-injection valve by more than 10 centimeters.

13. The water-injection system according to claim 9, wherein the water-injection valve is positioned at an elevated height relative to the metering valve.

14. The water-injection system according to claim 9, wherein the metering valve is spaced apart from the water-injection valve by more than 10 centimeters and the water-injection valve is positioned at an elevated height relative to the metering valve.

15. The water-injection system according to claim 9, wherein the metering valve is spaced apart from the water-injection valve by more than 30 centimeters and the water-injection valve is positioned at an elevated height relative to the metering valve.

16. A water-injection system for injecting water into a steam system of a power plant and cooling steam in the steam system, the water-injection system comprising:

a supply unit comprising a storage container, a filter, a storage volume and a pump;

a metering unit in fluid communication with the supply unit and comprising a metering valve, a servo valve, a restrictor and a valve slide; and an injection unit comprising a spring and a water-injection valve;

wherein the pump is configured to pump water from the storage container to the metering unit, the servo valve is configured to be electromagnetically actuated into an open position, the metering valve is configured to move from a closed position to an open position when the servo valve is actuated into the open position and via the water pumped from the storage container to the metering unit such that water flows from the metering unit to the injection unit, and the water injection valve is configured to move from a closed position to an open position via the water flowing from the metering unit to the injection unit such that water is injected into the steam system of the power plant and steam in the steam system is cooled.

17. The water-injection system according to claim 16, wherein the water-injection valve is positioned at an elevated height relative to the metering valve.

18. The water-injection system according to claim 16, wherein the metering valve is spaced apart from the water-injection valve by more than 50 centimeters.

* * * * *